US005845637A

United States Patent [19]

Knott

[11] Patent Number: 5,845,637

[45] Date of Patent: Dec. 8, 1998

[54] SURFACE BREATHING DEVICE

[75] Inventor: Gilbert L. Knott, Colchester, Conn.

[73] Assignee: Tech-One, Inc., Colchester, Conn.

[21] Appl. No.: 780,856

[22] Filed: Jan. 9, 1997

[51] Int. Cl.[6] ..... A62B 9/02

[52] U.S. Cl. ..... 128/207.12; 128/205.24; 128/206.21

[58] Field of Search ..... 128/200.24, 204.18, 128/205.24, 205.25, 206.21, 206.28, 207.12, 912; 137/DIG. 9

[56] References Cited

U.S. PATENT DOCUMENTS

| | | | |
|---|---|---|---|
| 4,226,234 | 10/1980 | Gunderson | 128/205.24 |
| 4,440,163 | 4/1984 | Spergel | 128/205.13 |
| 4,606,340 | 8/1986 | Ansite | 128/205.24 |
| 5,438,981 | 8/1995 | Starr et al. | 128/205.24 |

FOREIGN PATENT DOCUMENTS

| | | | |
|---|---|---|---|
| 0054714 | 6/1982 | European Pat. Off. | 128/912 |

*Primary Examiner*—Aaron J. Lewis
*Assistant Examiner*—V. Srivastava
*Attorney, Agent, or Firm*—Fishman, Dionne, Cantor & Colburn

[57] ABSTRACT

An ambient air breathing device for use in combination with a full face mask. Full face masks are intended to be sealed around periphery of the face of the wearer and, therefore, require that the wearer breath on tanked air even before such air would be necessary to sustain life. The breathing device of the invention allows the wearer to breathe ambient air thus conserving otherwise supplied air for use when needed.

18 Claims, 5 Drawing Sheets

SURFACE BREATHING DEVICE

BACKGROUND OF THE INVENTION

1. Field of the Invention

The invention relates primarily to arts in which fill face mask protective equipment is required. More particularly, full face masks, to be effective, have a seal around the periphery of the face and obligate the consumption of compressed or otherwise supplied air. The device of the invention is an open or closed valve mounted on a full face mask employable primarily: 1) underwater; 2) in contaminated areas and to allow personnel to breathe ambient air prior to and subsequent to exposure to the unbreathable fluid.

2. Prior Art

Providing personnel with the ability to breathe in a nonbreathable environment has always been an important goal of mankind. Self contained breathing apparati for underwater or other inhospitable conditions have been employed for a number of years. A drawback of many prior art systems is that the breathing device requires the wearer to hold the same within the oral cavity which not only causes fatigue but renders communication by mouth virtually impossible. While these systems are effective for maintaining the life of the wearer they were certainly not a panacea for safety. More recently, full face mask systems which employ modem polymers to provide a reliable seal around the perimeter of the face of wearer allow the wearer to breathe from the self contained breathing apparatus while keeping his mouth free of obstructions. This provided the important opportunity for communication by mouth. Because of this advance, people can now communicate through radio devices or even to some extent by mouth to other personnel. While this was a great advance for safety in the arts of scuba diving, etc. full face masks require the wearer to breathe from the compressed air supply once the mask is secured in place. Since oftentimes the personnel wearing the masks wish to be "suited up" prior to arriving at their destination, they necessarily must deplete the valuable compressed air supply while they are still in an environment in which they can breath ambient air. This is because of the air and water tight seal of the mask around the face of the wearer. Depletion of air supply creates significant dangers of its own by increasing the risk of an accident (running out of air). This is a significant drawback to the benefits provided by prior art commercial fall face systems due to the fact that while safety is increased because of the ability of communication, safety is decreased by the reduced time available on the compressed air. Thus the industry is in need of an apparatus capable of reliably allowing the wearer to breath ambient air. Providing such a device will extend the compressed air time for personnel while allowing them to be "suited up" as early as practicable.

SUMMARY OF THE INVENTION

The above-discussed and other drawbacks and deficiencies of the prior art are overcome or alleviated by the ambient air breathing device of the invention.

The invention comprises a valve body sealably interconnectable with a full face mask and easily manually movable between full open and full closed positions. By extending the outer housing of the valve device, seals are separated so as to allow a sufficiently uninhibited air stream through the valves inner and outer bodies to facilitate normal breathing. By opening the valve, personnel having a fully secured fill face mask may breathe ambient air thus conserving the compressed air supply. Upon deploying of personnel into the nonbreathable environment, the valve need merely be closed by moving the outer housing relative to the inner housing. A reliable seal is created by a system of o-rings and close tolerance machined parts. In a preferred embodiment the valve is retained in the engaged position with the face mask by an o-ring. This provides a redundant seal and while reliably retaining the valve against the mask and provides for relatively easy disassembly of the device from the mask by removal of the o-ring.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
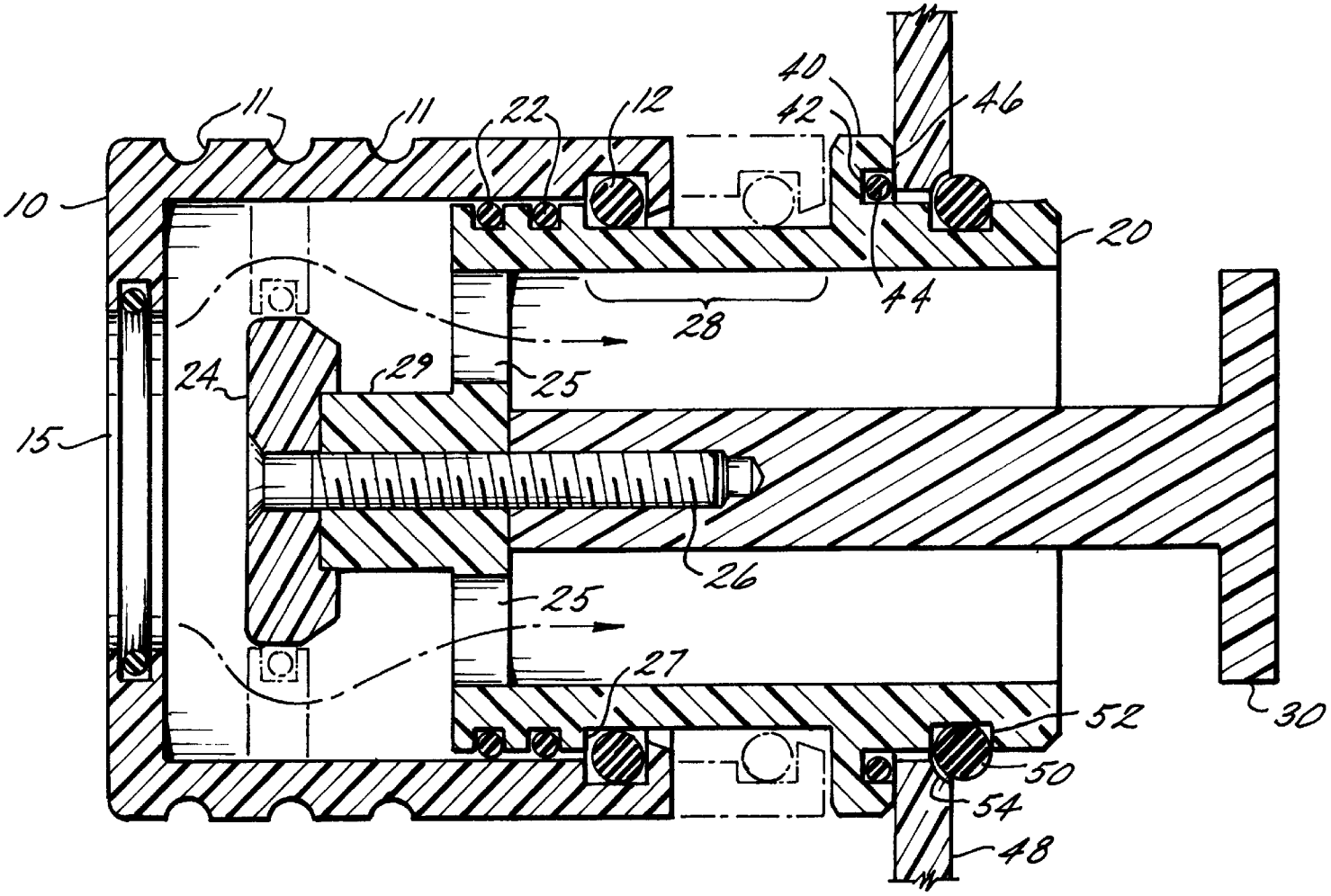
FIG. 1 is a cross-section of the invention with solid lines indicating the open position and phantom lines indicating the closed position.
Figure 2:
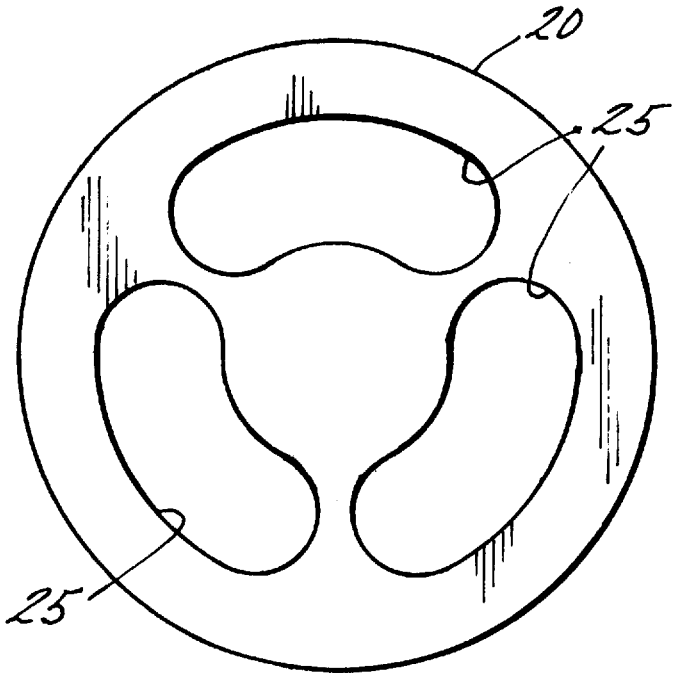
FIG. 2 is an illustration of the opening pattern of the inner housing.

Referring to FIGS. 1 and 2, the most preferred embodiment of the invention is illustrated and will be understood by one of ordinary skill in the art upon exposure to the following description. The device comprises an outer housing 10 and an inner housing 20 which are movable relative to one another and are sealed (in the closed position) to prevent influx of any fluid by outer housing lock seal 12 and inner housing redundant seals 22. The open position is illustrated in FIG. 1 in solid lines and the closed position is illustrated in phantom; thus, the stroke of the device is apparent. A further seal ring of outer housing 10 is seal ring 14 which prevents the entry of fluid past stopper 24 when the device is in a closed position. Stopper 24 may be machined as a single piece with inner housing 20, however, such machining would be difficult and expensive and, therefore, the preferred embodiment employs a separate piece to act as stopper 24 which is then attached to inner housing 20. This is the embodiment illustrated in FIG. 1. The most preferred attachment means is by screw, however other fastening means (adhering, welding, etc.) are, of course, available and acceptable.

One of the benefits of employing a screw 26 is that the screw not only maintains stopper 24 in secure engagement with inner housing 20 but provides for attachment of a deflector 30 to the inner housing 20. Deflector 30 is advantageous to move fresh air to more of the volume of the mask. As one of skill in the art will appreciate, the fewer fastening means is provided in the apparatus, the better.

Features of the inner housing 20 include slide region 28 which is provided for movement of outer housing 10 between the open and to the closed position. This is the most preferred embodiment. It should be noted however, that a thread or lever, etc. could be employed to move the outer housing 10. Regardless of the type of movement structure, it is important that the amount of movement be sufficient to allow air ingress to facilitate breathing anywhere from at rest to accelerated breathing when the wearer is strenuously working. While the ratios of the slide distance of region 28, size of main aperture (or inlet) 15 and size of openings 25 are all important to a relatively non-turbulent flow and thereby minimization of negative pressure to breathing, the preferred amount of slide is determined by measuring an imaginary cylinder extending from the periphery of stopper 24 to the defining surface of inlet 15. Since stopper 24 actually rests in inlet 15 when closed, the imaginary cylinder is generally true and, therefore, is subject to the general formula:

$$\Pi \times \text{Diameter of the cylinder} \times \text{height of cylinder} = \text{surface area of cylinder}$$

for the surface area of a cylinder. The most preferred embodiment employs an area of that cylinder which calculates to 15% to 25% larger than the area of inlet 15.

Preferred ranges herein are dictated by overall size of the device, available mounting space on the mask and NIOSH tables for acceptable rates of flow in liters per minute (LPM) for expected breathing for a given work load. In order to ensure that the device of the invention performs in all situations the parameters discussed above, and in more detail below, are selected to allow at least 102 LPM flow without allowing negative pressure to exceed 2.8 inches of water column. Positive exhalation pressure may not exceed 0.8 inches of water column (the water column numbers referred to herein are for a gas mask flowing at 85 liters per minute (as codified at 30 C.F.R. 11) because no standards exist for an ambient air breathing devices).

Aiding in preventing outer housing 10 from being pulled too far outward, thus defeating the device, is shoulder 27 which provides an interference to the movement of seal 12 as well as providing structure for grooves into which seals 22 are mounted. This will be clearly understood by one of skill in the art by reference to the drawings.

The device of the invention also includes a unique mounting system providing for redundant seals. This is accomplished by the carefully machined seal flange 40 having a groove 42 to receive an o-ring 44. The seal flange 40 most preferably includes a pressure face 46 which takes into account the depth of groove 42 and a cross-section of the o-ring 44 to be placed therein such that deflection of the o-ring is caused against material 48 prior to pressure face 46 contacting material 48. By machining such that pressure face 46 does not contact material 48 prior to deflection of o-ring 44, a reliable water tight seal is ensured.

Figure 3:
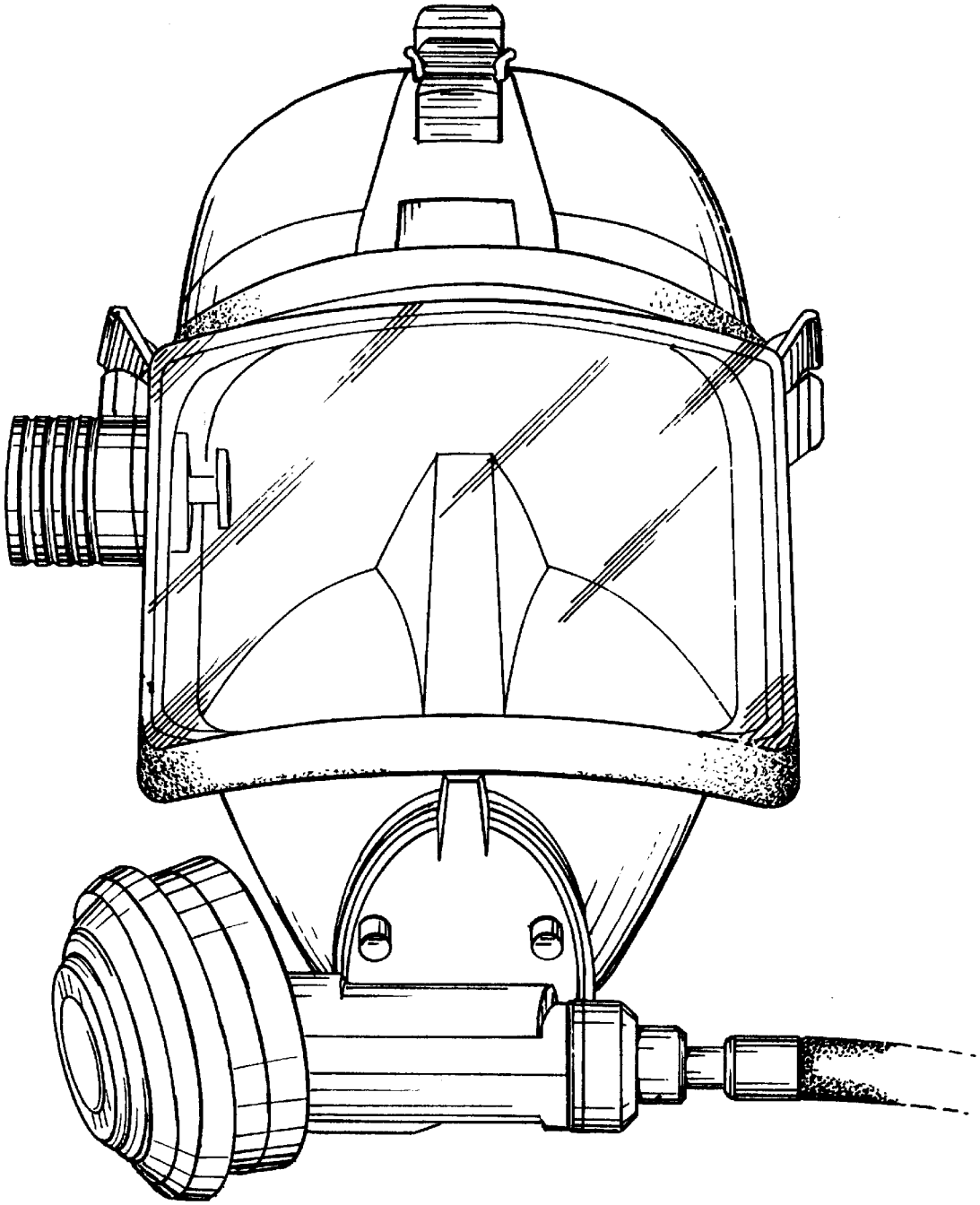
FIG. 3 is an illustration of the device mated with a full face mask.
Figure 4:
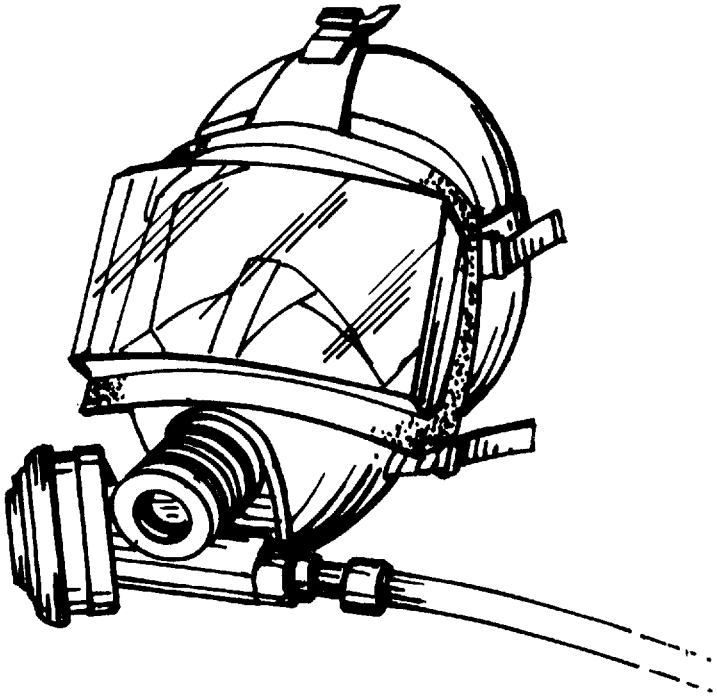
FIG. 4 is an alternate view of the device mated with a full face mask in an alternative position.

On the internal side of material 48 the device of the invention is locked in place and double sealed by lock o-ring 50 which is positioned within groove 52 and is in pressurized engagement with, most preferably, an arcuate surface 54 on the backside of material 48. With these parts in place the device of the invention is securely attached to the face mask and will not leak. The device as mounted is illustrated in FIGS. 3 and 4.

As FIG. 1 is illustrated in the open position flow arrows are also provided to more clearly point out the operation of the present invention. The direction of the flow arrow indicates placement of openings 25 which most preferably comprise three approximately 110° arcuate holes to reduce turbulence. One of skill in the art will understand that the degree of openness is limited by the amount of material required to be left connecting stopper mount 29 to the body of inner housing 20 and by fluid dynamics because a turbulent flow creates excess drag on the flow of air and makes breathing difficult. General safety standards for breathing through valves differ according to which agency publishes the same. The most stringent standard is dictated by NIOSH which requires an 85 LPM rate of air inflow and outflow. The device of the invention meets and exceeds this standard by providing a main aperture or inlet 15 of about ≧0.7 inch in diameter and an area of the openings 25 which is about 15% to about 25% larger. It should be understood that the particular measurements provided are for the most preferred embodiment and that other measurements could be employed where mounting space is available on the mask and a 85 LPM flow rate is maintained. Openings 25 and main aperture (or inlet) 15 are sized wherein the openings 25 colletively are 15%–25% larger in order to reduce turbulence and thus reduce resistance to the flow of air to the user.

Figure 5:
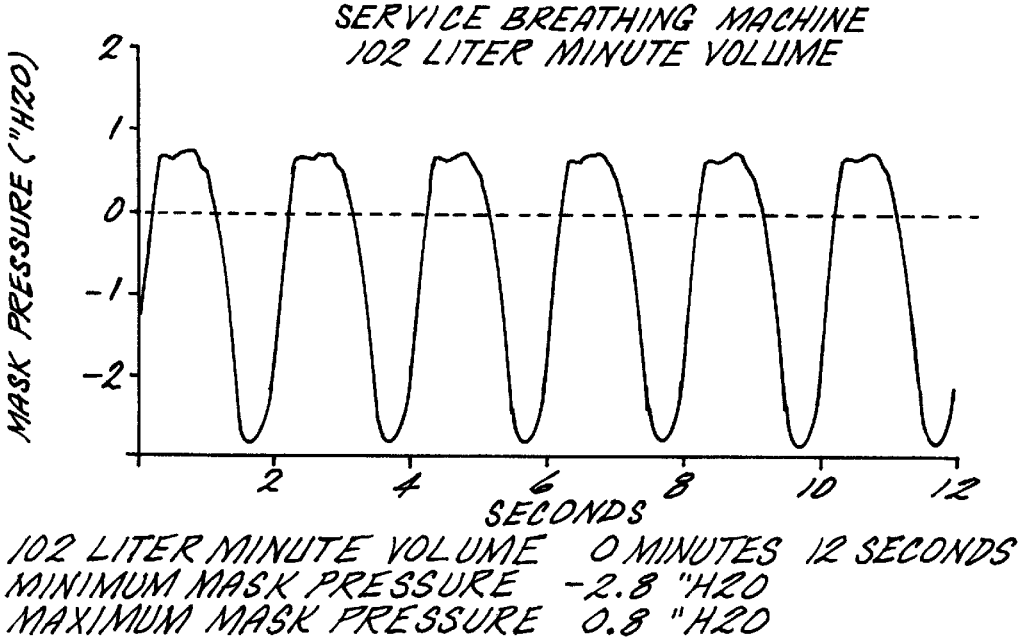
FIG. 5 is a 102 liter per minute volume test graph.
Figure 6:
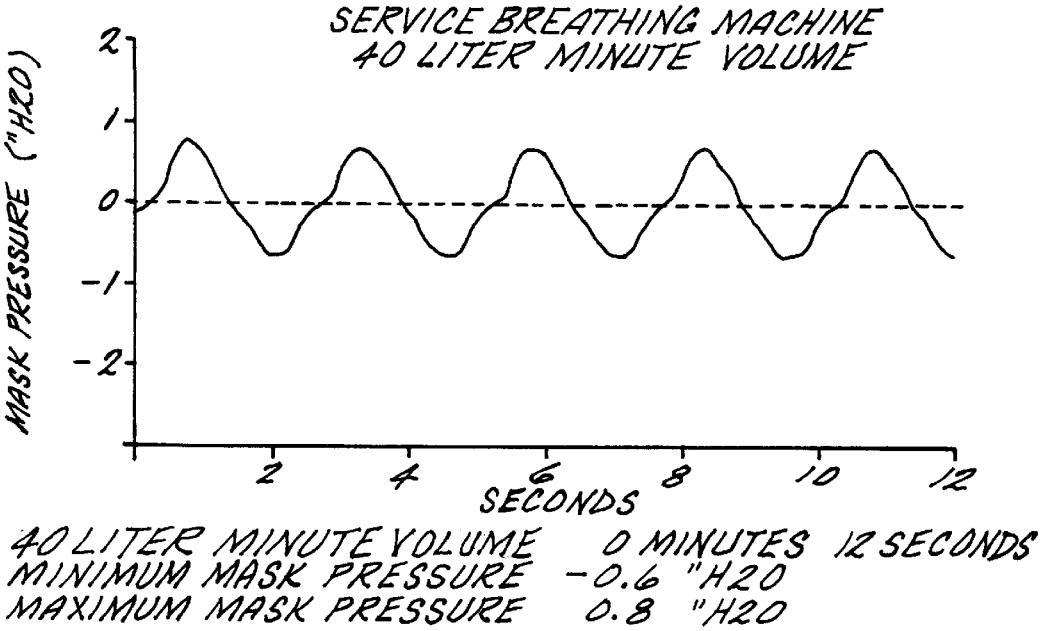
FIG. 6 is a 40 liter per minute volume test graph.

Testing of the preferred device has yielded the results (see FIGS. 5 and 6) taken at 102 LPM rate and a 40 LPM rate. The 102 LPM rate is expected for a normal human running uphill and the 40 LPM rate is expected for one engaged in maximum walking speed or swimming (these levels have been set forth in the U.S. Navy Diving Manual Volume pgs. 3–10).

In order to assist operation of the present invention grooves 11 are cut in outer housing 10. The device is preferably composed of plastic although metals can be used, and is most preferably of Delrin® (trademark of DuPont Corp.) or glass filled nylon material.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A valve for a self contained breathing apparatus comprising:

a) an inner housing of a generally tubular shape defining a conduit therein and having at least one of two ends adapted to allow through passage of fluid into said conduit while supporting a stopper, said inner housing having an outer profile adapted to accept and retain a plurality of seals providing a fluid tight seal, and be mountable in a separate structure having a hole therein of a dimension to accept a portion of said inner housing, said inner housing further including a flange adapted to bear against said separate structure to limit movement;

b) an outer housing of tubular shape dimensioned to fit closely perimetrically around said inner housing and be fluid tightly engaged therewith, said outer housing being manually moveable relative to said inner housing between a closed position wherein ambient fluid is prevented from passing into said conduit of said inner housing and an open position wherein ambient fluid is passable into said conduit in said inner housing, said outer housing having a groove on an inside diameter of said outer housing to receive a seal to fluid tightly seal against said inner housing, said outer housing further including at one end thereof, an opening having a seal perimetrically located therein and dimensioned to fluid sealably engage said stopper when said valve is closed to fluid passage.

2. A valve for a self contained breathing apparatus as claimed in claim 1 wherein said end adapted to allow through passage of fluid into said conduit includes three openings.

3. A valve for a self contained breathing apparatus as claimed in claim 2 wherein said inner housing is of circular cross section.

4. A valve for a self contained breathing apparatus as claimed in claim 3 wherein in each said opening is about 110° of arc of said circular cross section.

5. A valve for a self contained breathing apparatus as claimed in claim 1 wherein said outer housing is textured.

6. A valve for a self contained breathing apparatus as claimed in claim 1 wherein said end adaptable to allow through passage of fluid into said conduit, includes at least one opening which is about 15% to about 25% larger in total area than said opening at said one end of said outer housing.

7. A valve for a self contained breathing apparatus as claimed in claim 1 wherein said valve is plastic.

8. A valve for a self contained breathing apparatus as claimed in claim 1 wherein said valve is metal.

9. A valve for a self contained breathing apparatus as claimed in claim 7 wherein said plastic is an acetyl polymer.

10. A valve for a self contained breathing apparatus as claimed in claim 7 wherein said plastic is glass-filled nylon.

11. A valve for a self contained breathing apparatus as claimed in claim 1 wherein said flange further includes an annular groove therein, said groove having a first seal therein such that said seal sealingly protrudes from said groove against said separate structure and wherein said outer profile further includes a lip located such that an o-ring is trappable between said lip and said separate structure to lock said valve to said separate structure.

12. A valve for a self contained breathing apparatus as claimed in claim 1 wherein said outer housing is moveably connected to said inner housing via a slide region on said inner housing, said slide region being of a radial dimension smaller than surrounding dimensions of said inner housing to prevent removal of said outer housing from said housing.

13. A valve for a self contained breathing apparatus as claimed in claim 12 wherein said slide region extends for a preselected distance to provide a gap between said stopper and said opening of said outer housing, said gap having a circumferential area which is about 15% to about 25% larger than an area of said end adapted to allow through passage of fluid into said conduit.

14. A valve for a self contained breathing apparatus as claimed in claim 1 wherein said opening of said outer housing is ≧ about 0.7 inches in diameter.

15. A method for providing ambient air to personnel wearing a full-face mask comprising:

a) providing a full-face mask and an ambient air valve, said valve having:

1) an inner housing of a generally tubular shape defining a conduit therein and having at least one of two ends adapted to allow through passage of fluid into said conduit while supporting a stopper, said inner housing having an outer profile adapted to accept and retain a plurality of seals proving a fluid tight seal, and be mountable in a separate structure having a hole therein of a dimension to accept a portion of said inner housing, said inner housing further including a flange adapted to bear against said separate structure to limit movement;

2) an outer housing of tubular shape dimensioned to fit closely perimetrically around said inner housing and be fluid tightly engaged therewith, said outer housing being manually moveable relative to said inner housing between a closed position wherein ambient fluid is prevented from passing into said conduit of said inner housing and an opening position wherein ambient fluid is passable into said conduit in said inner housing, said outer housing having a groove on an inside diameter of said outer housing to receive a seal to fluid tightly seal against said inner housing, said outer housing further including at one end thereof, an opening having a seal perimetrically located therein and dimensioned to fluid sealably engage said stopper when said valve is closed to fluid passage;

b) mounting said breathing device in said full-face mask which includes said separate structure;

c) donning said full-faced mask;

d) opening said breathing device; and e) breathing ambient air available through said breathing device.

16. A method for providing ambient air to personnel wearing a full-face mask as claimed in claim 15 wherein said mounting said breathing device includes passing said inner housing into said separate structure and installing a retainer to prevent removal of the inner housing from said separate structure.

17. A method for providing ambient air to personnel wearing a full-face mask as claimed in claim 16 wherein said retainer is an o-ring.

18. A valve for a self contained breathing apparatus in combination with a full-face mask comprising:

a) an inner housing of a generally tubular shape defining a conduit therein and having at least one of two ends adapted to allow through passage of fluid into said conduit while supporting a stopper, said inner housing having an outer profile adapted to accept and retain a plurality of seals proving a fluid tight seal, and be mountable in a separate structure having a hole therein of a dimension to accept a portion of said inner housing, said inner housing further including a flange adapted to bear against said separate structure to limit movement;

b) an outer housing of tubular shape dimensioned to fit closely perimetrically around said inner housing and be fluid tightly engaged therewith, said outer housing being manually moveable relative to said inner housing between a closed position wherein ambient fluid is prevented from passing into said conduit of said inner housing and an open position wherein ambient fluid is passable into said conduit in said inner housing, said outer housing having a groove on said inside diameter of said outer housing to receive a seal to fluid tightly seal against said inner housing, said outer housing further including at one end thereof, an opening having a seal perimetrically located therein and dimensioned to fluid sealably engage said stopper when said valve is closed to fluid passage; and c) a full-face mask which includes said separate structure, said inner housing being secured within said hole of said separate structure whereby said outer housing is being secured within said hole of said separate structure whereby when said outer housing is in said open position, ambient fluid is passable from an exterior of said mask to an interior of said mask and when said outer housing is in the closed position, fluid on the exterior of said mask is prevented from passing into said interior of said mask.

* * * * *